US010822571B2

(12) United States Patent
Dohner et al.

(10) Patent No.: US 10,822,571 B2
(45) Date of Patent: Nov. 3, 2020

(54) LUBRICANT ADDITIVE COMPOSITION SUITABLE FOR LUBRICATING TWO-STROKE ENGINES FUELED WITH HEAVY FUELS

(71) Applicant: The Lubrizol Corporation, Wickliffe, OH (US)

(72) Inventors: Brent R. Dohner, Concord, OH (US); W. Preston Barnes, Concord, OH (US)

( * ) Notice: Subject to any disclaimer, the term of this patent is extended or adjusted under 35 U.S.C. 154(b) by 60 days.

(21) Appl. No.: 14/816,290

(22) Filed: Aug. 3, 2015

(65) Prior Publication Data

US 2015/0337234 A1 Nov. 26, 2015

Related U.S. Application Data

(63) Continuation of application No. 12/922,517, filed as application No. PCT/US2009/036138 on Mar. 5, 2009, now abandoned.

(60) Provisional application No. 61/037,744, filed on Mar. 19, 2008.

(51) Int. Cl.

| | |
|---|---|
| ***C10L 1/08*** | (2006.01) |
| ***C10L 1/10*** | (2006.01) |
| ***C10L 1/26*** | (2006.01) |
| ***C10M 169/04*** | (2006.01) |
| ***C10L 10/08*** | (2006.01) |
| ***C10L 1/14*** | (2006.01) |
| ***C10L 1/16*** | (2006.01) |
| ***C10L 1/18*** | (2006.01) |
| ***C10L 1/22*** | (2006.01) |
| *C10L 1/185* | (2006.01) |
| *C10L 1/232* | (2006.01) |
| *C10L 1/188* | (2006.01) |
| *C10L 1/222* | (2006.01) |
| *C10N 20/02* | (2006.01) |
| *C10N 30/00* | (2006.01) |
| *C10N 40/26* | (2006.01) |

(52) U.S. Cl.

CPC ..... *C10M 169/045* (2013.01); *C10L 1/143* (2013.01); *C10L 1/16* (2013.01); *C10L 1/18* (2013.01); *C10L 1/22* (2013.01); *C10L 10/08* (2013.01); *C10M 169/04* (2013.01); *C10L 1/1633* (2013.01); *C10L 1/1691* (2013.01); *C10L 1/1852* (2013.01); *C10L 1/1881* (2013.01); *C10L 1/2222* (2013.01); *C10L 1/232* (2013.01); *C10L 2200/0259* (2013.01); *C10L 2270/04* (2013.01); *C10M 2203/1006* (2013.01); *C10M 2203/108* (2013.01); *C10M 2205/0265* (2013.01); *C10M 2207/283* (2013.01); *C10M 2215/08* (2013.01); *C10M 2215/28* (2013.01); *C10M 2217/043* (2013.01); *C10N 2020/02* (2013.01); *C10N 2030/74* (2020.05); *C10N 2040/26* (2013.01)

(58) Field of Classification Search

CPC ..... C10L 1/08; C10L 1/10; C10L 1/26

See application file for complete search history.

(56) References Cited

U.S. PATENT DOCUMENTS

| | | | | |
|---|---|---|---|---|
| 5,264,005 | A | 11/1993 | Blythe | |
| 5,411,559 | A * | 5/1995 | Malfer | C10L 1/2387 44/347 |
| 6,279,550 | B1 * | 8/2001 | Bryant | F02B 1/12 123/559.1 |
| 6,457,463 | B1 * | 10/2002 | McChesney | F02B 61/045 123/575 |
| 6,907,870 | B2 * | 6/2005 | zur Loye | F02B 1/04 123/27 R |
| 2003/0176301 | A1 * | 9/2003 | Barnes | C10M 111/04 508/458 |
| 2004/0211112 | A1 * | 10/2004 | Clague | C10L 1/14 44/354 |
| 2007/0232506 | A1 | 10/2007 | Gao et al. | |
| 2008/0009428 | A1 * | 1/2008 | Svarcas | C10M 163/00 508/513 |

FOREIGN PATENT DOCUMENTS

| | | | |
|---|---|---|---|
| EP | 1138753 | A1 | 10/2001 |
| WO | 98/18887 | A1 | 5/1998 |
| WO | 03/089555 | A1 | 10/2003 |
| WO | 03/089556 | A1 | 10/2003 |
| WO | 2006/004806 | A1 | 1/2006 |

OTHER PUBLICATIONS

Lee, J., Duddy, B., Thurston, M., Beardslee, D. et al., "Increasing the Lubricity of JP-8 to Fuel Two-stroke Spark Ignition Engines for Midsized Unmanned Aerial Vehicles," Jan. 2011, SAE Technical Paper 2011-01-0332, Abstract (Year: 2011).*

* cited by examiner

*Primary Examiner* — Ellen M McAvoy
*Assistant Examiner* — Ming Cheung Po
(74) *Attorney, Agent, or Firm* — Michael Miller; Teresan Gilbert

(57) ABSTRACT

A lubricant suitable for lubricating a two-stroke cycle engine which is fueled with a liquid fuel having a volatility less than that of gasoline comprises an oleaginous synthetic ester, a normally liquid solvent having a kinematic viscosity of less than about 5 or 2 $mm^2/s$ at 100° C. and a nitrogen-containing dispersant bearing a hydrocarbyl group of at least 26 carbon atoms and having a nitrogen content of at least 4 percent by weight. The nitrogen content of the lubricant is at least about 0.3 percent by weight.

9 Claims, No Drawings

LUBRICANT ADDITIVE COMPOSITION SUITABLE FOR LUBRICATING TWO-STROKE ENGINES FUELED WITH HEAVY FUELS

BACKGROUND OF THE INVENTION

The present invention relates to a lubricant composition and fuel-lubricant mixture useful for two-stroke engines that are fueled with fuels heavier than gasoline, e.g., diesel or jet fuels.

There has recently been recognized a need to allow the successful use of heavy fuels such as diesel fuel or jet fuel in two cycle engines which have traditionally been designed to operate on conventional gasoline. Such a use minimizes the need to store more highly flammable fuel such as gasoline, particularly in hazardous environments such as on board ships. It also minimizes the need for storing and handling multiple types of fuels.

In conventionally fueled two cycle engines, a mixture of lubricating fluid and gasoline typically mix before and in the combustion chamber, providing a homogeneous mixture that provides adequate lubrication of critical engine components while minimizing harmful deposits that may otherwise lead to component failure. Jet fuels, for example JP5, a grade of jet aviation fuel, on the other hand, are a fuels of lower volatility. In order to be successfully burned in the cylinders of internal combustion two cycle engines, it is typically introduced as a stratified charge such that a relatively rich mixture is allowed to form in the vicinity of a spark plug. Once this mixture is spark ignited, the flame front propagates into the cylinder in a manner similar to that of compression ignition engines operating on diesel fuels. Burning of jet fuel that includes a mixture of conventional two cycle lubricating fluid such as those that fall under the NMMA (National Marine Manufacturers Association) TCW3 specification can lead to the formation of harmful particulates and other incomplete combustion byproducts, and engines operated in this way have experienced early failures. These engine failures have been brought on by the formation of deposits, early ring sticking, and lubricity issues that eventually cause premature destruction of the pistons. In order for these two cycle engines to successfully function on jet fuel such as JP5 and other heavier fuels, a new two cycle lubricating fluid is needed.

EP1138753A2, Oct. 4, 2001, discloses a lubricant composition for air-cooled two-stroke cycle engine having a Mannich detergent and an ashless dispersant, wherein the ratio of the Mannich detergent to the ashless dispersant is 3:1 to 5:1. The detergency additive provides detergency when used in a lubricating oil composition for air-cooled two-stroke cycle engines.

WO03/89555, Oct. 30, 2003, discloses a low nitrogen content composition suitable for use in a direct fuel injection two-stroke engine comprising an oil of lubricating viscosity and a combination of three nitrogen containing dispersants.

US patent publication 2008-0009428, Jan. 10, 2008, Svarcas et al., equivalent to PCT publication WO2006/004806, Jan. 12, 2006, discloses a lubricant additive composition suitable for lubricating, preventing deposit formation, or cleaning-up of two-stroke engines. It includes an oil of lubricating viscosity, a liquid solvent, a synthetic ester, a Mannich dispersant, and a condensation product of a fatty acid with a polyamine.

SUMMARY OF THE INVENTION

The present invention provides lubricant suitable for lubricating a two-stroke cycle engine which is fueled with a liquid fuel having a volatility less than that of gasoline, said lubricant comprising:

(a) at least 5 percent by weight of an oleagenous synthetic ester;

(b) at least 5 percent by weight of a normally liquid solvent having a kinematic viscosity of less than 5 or less than 2 $mm^2/s$ at 100° C.; and (c) 3 to 30 percent by weight of a nitrogen-containing dispersant bearing a hydrocarbyl group of at least 26 carbon atoms and having a nitrogen content of at least 3 percent by weight;

wherein the nitrogen content of the lubricant is at least 0.2 percent by weight.

The invention also provides a method for lubricating a two-stroke cycle internal combustion engine which is fueled with a liquid fuel of volatility less than that of gasoline, comprising supplying to said engine said fuel and a lubricating amount of the lubricant composition as defined above, which fuel and lubricant composition may optionally be premixed externally to the engine.

The invention also provides a fuel composition comprising a liquid fuel of volatility less than that of gasoline and a lubricating amount of the lubricant as defined above.

DETAILED DESCRIPTION OF THE INVENTION

Various preferred features and embodiments will be described below by way of non-limiting illustration.

The Fuel

The lubricant as described herein is particularly suitable for use in combination with a fuel having a volatility less than that of gasoline. Examples of such fuels are sometimes referred to as fuel oils, which term may include kerosene, diesel fuel, home heating oil, coal oil, and jet fuels (or aviation turbine fuels) such as JP5. The fuel known as JP-5, or JP5 (for "Jet Propellant") is described, for instance, in Kirk-Othmer Encyclopedia of Chemical Technology, Third Edition, 1980, vol. 3, pages 331-332, along with other related jet aviation fuels. JP-5, in particular, is a kerosene-type fuel which has a high flash point, minimum 60° C. It may contain up to 25% vol. aromatics and has a maximum freezing point of −46° C. and a distillation range of 205-290° C. (10% through end point). It is also believed to be known by its NATO code F-44 or by the name "avcat" fuel oil No. 5, and residual oil no. 5 JP-5 is believed to be a complex mixture of hydrocarbons, containing alkanes, naphthenes, and aromatic hydrocarbons.

Such fuels may also be described as middle distillate fuels. Middle distillate fuels are obtained from the refining of a petroleum or mineral oil source and fuels from a synthetic process such as a Fischer-Tropsch fuel from a Fischer-Tropsch process. Middle distillate fuels generally have a distillation temperature range of 121 to 371° C., which is greater than that of gasoline or naphtha with some overlap. Middle distillate fuels include distillation fractions for diesel, jet, heating oil, gas oil, and kerosene. Middle distillate fuels generally contain aromatic hydrocarbons, including high levels of aromatic hydrocarbons near 85% by volume or low levels of aromatic hydrocarbons near 3% by volume when highly refined, and in other instances can contain aromatic hydrocarbons from 3 to 60% by volume and from 3 to 40% by volume.

In a similar category are biodiesel fuels, which can be derived from animal fats and/or vegetable oils to include biomass sources such as plant seeds as described in U.S. Pat. No. 6,166,231. Biodiesel fuels include esters of naturally occurring fatty acids such as the methyl ester of rapeseed oil which can generally be prepared by transesterifying a triglyceride of a natural fat or oil with an aliphatic alcohol having 1 to 10 carbon atoms. In an embodiment of the invention the diesel fuel comprises a middle distillate fuel, a Fischer-Tropsch fuel, a biodiesel fuel, or mixtures thereof. A mixture can be, for example, a mixture of one or more distillate fuels and one or more biodiesel fuels or a mixture of two or more biodiesel fuels.

The Lubricant Composition.

As is typical for two-cycle engines, the lubricant composition will typically be mixed with the fuel and fed to the engine in a manner which is well known to those skilled in the art. The fuel and lubricant may thus be premixed externally to the engine and the mixture fed to the engine. In an alternative arrangement, the fuel and lubricant are not premixed externally to the engine but may undergo mixing within the engine, either prior to or at the time they are injected into a combustion chamber. Such arrangements may be characteristic of engines equipped with a direct injection fuel system. In either event, the lubricant composition is, for this type of engine, not typically retained in a sump and circulated therefrom through the engine. The lubricant composition is typically mixed with the fuel in a ratio of 0.5:100 or 1:100 and above, up to about 6:100. Alternative ratios include 2:100 to 5:100 or 2.5:100 to 4:100 or about 3.1:100, which may also be expressed as 1:32 or about 3 percent by weight. It may also be expressed as 1 percent to 6 percent by weight, or 2 to 4 percent by weight. The lubricant composition may comprise the following components, as well as other conventional components.

The Synthetic Ester

The composition of the present invention comprises one or more oleaginous synthetic esters. By "oleaginous" is meant that the ester is oil-like in terms of viscosity or volatility. That is, it is not of such high molecular weight that it is a solid at room temperature nor of such low molecular weight that it does not have oil-like properties. An oleaginous synthetic ester may have a 100° C. kinematic viscosity, for instance, of 5 to 20 $mm^2/s$, or 7 to 18 or 10 to 15 $mm^2/s$.

Esters useful herein include those made from monocarboxylic acids having at least 5 carbon atoms, or at least 8 carbon atoms, for example, 8 to 30 or 12 to 30 or 12 to 24 or 16 to 20 carbon atoms, together with polyols and polyol ethers such as neopentyl glycol, trimethylolpropane, pentaerythritol, dipentaerythritol, and tripentaerythritol. Examples include esters of C8 monocarboxylic acids with pentaerythritol. Esters can also be monoesters, such as are available under the trade name Priolube 1976™ (C18-alkyl-COO—C20 alkyl).

Useful esters also include esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with any of variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

The amount of the oleaginous synthetic ester will be at least 5 percent by weight of the lubricant composition, or at least 10 percent or at least 20 percent, up to 50 percent or 40 or 30 percent. Suitable ranges may include combinations of the above values, or 15 to 30 percent or 20 to 25 percent by weight.

The Solvent

Another material present in the lubricant compositions is a solvent, which may be used to aid in the solubility of the additives in the lubricant or in the fuel with which it is conventionally to be mixed or to adjust the viscosity parameters of the lubricant. Typically such a material is a combustible solvent (other than oil of lubricating viscosity, described below, or the ester), having a flash point of less than about 105° C., in which the remaining components of the lubricant are soluble. The solvent is typically a hydrocarbonaceous solvent, that is, one which exhibits principally hydrocarbon character, even though relatively small numbers of heteroatoms may be present in the molecule. The solvent may be a hydrocarbon and may have predominantly non-aromatic (e.g., alkane) character. The solvent may thus comprises less than 20 percent by weight aromatic components and may be substantially free from polynuclear aromatic components. (Aromatic hydrocarbons, in sufficiently large quantity, may contribute to smoke upon combustion and are thus sometimes less desirable.) A particularly suitable solvent is kerosene, which is a non-aromatic petroleum distillate having a boiling range of 180-300° C. Another useful solvent is Stoddard solvent, which has a boiling range of 154-202° C.

The solvent is characterized by a kinematic viscosity of less than 5 $mm^2s^{-1}$ (cSt) at 100° C., such as less than 2.0 or 1.5 or 1.0 $mm^2s^{-1}$. Thus they are of lower viscosity than the oils of lubricating viscosity and the synthetic ester also employed in the invention, which, accordingly, may each have a kinematic viscosity of at least 1.0 or 1.5 or 2.0 or 5 $mm^2s^{-1}$ at 100° C.

The amount of the solvent is at least 5 percent by weight of the lubricant, or at least 10 percent, up to 50 or 40 or 30 percent. Suitable ranges may include combinations of the above values, or 15 to 30 percent by weight.

Oil of Lubricating Viscosity.

The lubricant of the present invention may also contain an additional oil of lubricating viscosity, other than the oleaginous synthetic ester described above. Oils of lubricating viscosity include natural and synthetic lubricating oils and mixtures thereof. Unrefined, refined and rerefined oils (and mixtures of each with each other) of the type disclosed hereinabove can be used in the lubricant compositions of the present invention. Other oils that can be used are oils prepared from a gas-to-liquid process such as those involving Fischer-Tropsch processing.

Natural oils include animal oils and vegetable oils (e.g., castor oil, lard oil) as well as liquid petroleum oils (i.e., mineral oils) and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include hydrocarbon oils such as polymerized and interpolymerized olefins (e.g., polybutylenes such as polyisobutene, polypropylenes, propylene-isobutylene copolymers, poly(1-hexenes, poly(1-octenes), poly(1-decenes), and mixtures thereof); alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof. Polymeric synthetic oil components will typically be polymerized to an extent to retain fluidity and lubricating properties. For example, isobutene may be suitably polymerized to a number average molecular weight of 850 to 1600, that is, around 1000.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide or propylene oxide, the alkyl and aryl ethers of these polyoxyalkylene polymers. However, synthetic esters, which are sometimes considered oil of lubricating viscosity, are separately considered, as a separate component for purposes of this invention.

In certain embodiments the lubricating oil contains a mineral oil, which may be an API grade I, II, or III mineral oil. The mineral oil may constitute the entire oil component or it may be a portion thereof. The amount of mineral oil may be, for example, 2 to 40 percent or 3 to 30 percent or 4 to 15 percent by weight of the lubricant mixture, in particular if another oil component is present. The amount of mineral oil may also be as low as 0%, particularly a suitable amount of solvent (described above) is present. Other oil component may be an olefin polymer such as polyisobutene, which may in certain embodiments be present in amounts of 2 to 40 percent or 10 to 35 percent or 20 to30 percent by weight of the lubricant mixtures. Other components that may be considered a part of the oil of lubricating viscosity include bright stock (a high viscosity mineral oil fraction), which may be typically present, if desired, in amounts of 1 to 5 or 1.5 to 3 percent by weight. Each of these components may be adjusted as desired, for instance, to provide particular viscosity properties to the lubricant.

The amount of this lubricating oil component or components in a fully formulated lubricant of the present invention (including the diluent or carrier oils present in the additional additive packages or individual additive components but excluding synthetic esters), if it is present, may typically be 20 to 50 percent by weight, or 25 to 45 percent, or 30 to 43 percent by weight.

The solvent, the oil, and the synthetic ester (to the extent that each of them may be present) may together comprise 60 to 90 percent by weight of the lubricant composition, such as 70 to 85 percent of 75 to 82 percent.

The Dispersants

The invention also contains a nitrogen-containing dispersant bearing at least one hydrocarbyl group of at least 26 carbon atoms and having a nitrogen content of at least 3 percent or at least 4 percent by weight, and in some embodiments up to 8 or 6 percent. The dispersant may be a dispersant of any of a variety of chemical types, but frequently it is a succinimide dispersant.

Succinimide dispersants are the condensation products of hydrocarbyl-substituted succinic acids or anhydrides with polyamines. They are terms "succinimide" dispersants although a variety of types of condensation are possible, including imide, amide, and salt. Succinimide dispersants have a variety of structures and have been represented generally, although incompletely, by formulas such as

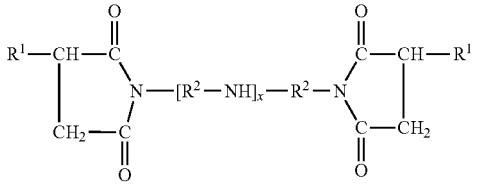

where each $R^1$ is independently an alkyl group, frequently a polyisobutylene group with a molecular weight of 500-5000, and $R^2$ are alkylene groups, commonly ethylene ($C_2H_4$) groups. The $R^1$ group or groups may be hydrocarbyl groups of at least 26 carbon atoms, or at least 30 or at least 40 or at least 60, and may be up to 500 or 200 or 100 or 80 carbon atoms. Such molecules are commonly derived from reaction of an alkenyl acylating agent with a polyamine, and a wide variety of linkages between the two moieties is possible beside the simple imide structure shown above, including a variety of amides, salts, and quaternary ammonium salts. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892.

The polyamine which reacts with the succinic acylating may be aliphatic, cycloaliphatic, heterocyclic or aromatic. Examples of the polyamines include those mentioned above, including alkylene polyamines, hydroxy containing polyamines, arylpolyamines, and heterocyclic polyamines.

Alkylene polyamines may be are represented by the formula

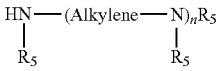

wherein n has an average value from 1, or 2 to 10, or to 7, or to 5, and the "Alkylene" group has from 1 or 2 to 10, or to 6, or to 4 carbon atoms. Each $R_5$ is independently hydrogen or an aliphatic or hydroxy-substituted aliphatic group of up to 30 carbon atoms.

Such alkylenepolyamines include methylenepolyamines, ethylenepolyamines, butylenepolyamines, propylenepolyamines, and pentylenepolyamines. The higher homologs and related heterocyclic amines such as piperazines and N-aminoalkyl-substituted piperazines are also included. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, and pentaethylenehexamine. Ethylenepolyamines are described in detail under the heading Ethylene Amines in Kirk Othmer's "Encyclopedia of Chemical Technology", 2d Edition, Vol. 7, pages 22-37, Interscience Publishers, New York (1965). Such polyamines may be prepared by the reaction of ethylene dichloride with ammonia or ethylene diamine or by reaction of an ethylene imine with a ring opening reagent such as water or ammonia.

Other useful types of polyamine mixtures are those resulting from stripping of the above-described polyamine mixtures to leave as residue what is often termed "polyamine bottoms". In general, alkylenepolyamine bottoms can be characterized as having less than 1% or less than 1% (by weight) material boiling below 200° C. A typical sample of such ethylene polyamine bottoms obtained from the Dow Chemical Company of Freeport, Tex. designated "E-100" has a specific gravity at 15.6° C. of 1.0168, a percent nitrogen by weight of 33.15 and a viscosity at 40° C. of 121 centistokes. These alkylenepolyamine bottoms can be reacted solely with the acylating agent or they can be used with other amines, polyamines, or mixtures thereof.

Another useful polyamine is a condensation reaction between at least one hydroxy compound with at least one polyamine as described above, containing at least one primary or secondary amino group. The hydroxy compounds may be polyhydric alcohols or amines. Examples of polyhydric amines include tri-(hydroxypropyl)amine, tris-(hydroxymethyl)amino methane (THAM), 2-amino-2-methyl-1,3-propanediol, N,N,N',N'-tetrakis(2-hydroxy-propyl) ethylenediamine, and N,N,N',N'-tetrakis(2-hydroxyethyl) ethylenediamine. Amine condensates and methods of making the same are described in U.S. Pat. No. 5,053,152

In another embodiment, the polyamines may be hydroxy-containing polyamines or heterocyclic polyamines such as aziridines, azetidines, azolidines, pyridines, pyrroles, indoles, piperidines, imidazoles, piperazines, isoindoles, purines, morpholines, thiomorpholines, N-aminoalkylmorpholines, N-amino alkylthiomorpholines, N-aminoalkylpiperazines, N,N'-diaminoalkyl-piperazines, azepines, azocines, azonines, azecines and tetra-, di- and perhydro derivatives of each of the above.

The substituted succinic acylating agent used in preparing the succinimide dispersant may be prepared by the so-called "chlorine" route or by the so-called "thermal" or "direct alkylation" routes. These routes are described in detail in published application US 2005-0202981, paragraphs 0014 through 0017. A direct alkylation or low-chlorine route is also described in U.S. Pat. No. 6,077,909, refer to column 6 line 13 through col. 7 line 62 and column 9 lines 10 through col. 10 line 11. Illustrative thermal or direct alkylation processes involve heating a polyolefin, typically at 180 to 250° C., with maleic anhydride under an inert atmosphere. Either reactant may be in excess. If the maleic anhydride is present in excess, the excess may be removed after reaction by distillation. These reactions may employ, as the polyolefin, high vinylidene polyisobutylene, that is, having > 75% terminal vinylidene groups ($\alpha$ and $\beta$ isomers).

The dispersant described herein is a high nitrogen dispersant. That is, the dispersant will contain a nitrogen atom content of at least 3 or 4 percent by weight (calculated on the basis of oil-free material), such as 4 to 12 percent or 4.2 to 10 percent or 4.3 to 8 percent or 4.4 to 5 percent by weight. A high nitrogen-content succinimide dispersant may be prepared by controlling the relative amounts of polyamine and hydrocarbyl succinic acylating agent that are reacted such that a stoichiometric excess of amine functionality will be present. For example, a high TBN succinimide dispersant may be prepared by reacting about 78 g of polyisobutene (m.w. 1000)—substituted succinic anhydride with about 12 g tetraethylenepentamine. Such a material will have residual basicity which may be expressed as Total Base Number (TBN, ASTM D 4739) in the region of 110 to 130 or 115 to 120.

The amount of the high nitrogen dispersant as described herein will be 3 to 30 percent by weight of the lubricant, or in certain embodiments 4 to 20 percent or 5 to 10 percent by weight.

Other dispersants may also be present. They may be lower nitrogen-content dispersants or they may have shorter hydrocarbyl chains (thus modifying their oil solubility parameters) but their presence may still be beneficial under various circumstances. One such may be a Mannich dispersant, sometimes referred to as a Mannich base dispersant. A Mannich dispersant is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent are generally the same as can be used for the hydrocarbyl substituent in the above-described succinimide dispersant. For instance, they can be prepared by polymerizing olefin monomers by well known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a C4 refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins.

Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69%, in a second instance of 50 to 69%, and in a third instance of 50 to 95%. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol which is used to prepare the Mannich dispersant can be prepared by alkylating phenol with an olefin or polyolefin described above, such as a polyisobutylene or polypropylene, using well-known alkylation methods.

The aldehyde used to form the Mannich dispersant can have 1 to 10 carbon atoms, and is generally formaldehyde or a reactive equivalent thereof such as formalin or paraformaldehyde.

The amine used to form the Mannich dispersant can be a monoamine or a polyamine, including those materials described above for the succinimide dispersants, including alkanolamines having one or more hydroxyl groups. Useful amines include ethanolamine, diethanolamine, methylamine, dimethylamine, ethylenediamine, dimethylaminopropylamine, diethylenetriamine and 2-(2-aminoethylamino) ethanol. The Mannich dispersant can be prepared by reacting a hydrocarbyl-substituted phenol, an aldehyde, and an amine as described in U.S. Pat. No. 5,697,988. In an embodiment of this invention the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The amount of the Mannich dispersant, if it is present, may typically be 1.1 to 15 percent by weight of the lubricating composition, in other embodiments 1.5 to 12 percent, or 2 to 10 percent or 3 to 9 percent or 5 to 8 percent by weight.

Another dispersant that may be present is a condensation product of a fatty hydrocarbyl monocarboxylic acylating agent, such as a fatty acid, with a polyamine. Such materials may have a high nitrogen content, in excess of 4 percent by weight, but, depending on the particular material they may not constitute the required high-nitrogen dispersant. For example, in many instances such materials may be prepared from an acid having fewer than 26 or 27 carbon atoms and thus may not have the required length of hydrocarbon group. However, it may be advantageous to have such materials present for other reasons.

The hydrocarbyl portion of the fatty hydrocarbyl monocarboxylic acylating agent can be an aliphatic group. The aliphatic group can be linear, branched, or a mixture thereof. The aliphatic group can be saturated, unsaturated, or a mixture thereof. The aliphatic group can be based on a carboxylic acid having 12 to 24 carbon atoms, in another instance 2 to 30 carbon atoms, and in a further instance 4 to 22 carbon atoms, or 8, 10, or 12, to 20 carbon atoms. If the fatty hydrocarbyl monocarboxylic acylating agent is an aliphatic carboxylic acid, it may be seen as comprising a carboxy group (COOH) and an aliphatic group. The monocarboxylic acylating agent can be a monocarboxylic acid or a reactive equivalent thereof, such as an anhydride, an ester, or an acid halide such as stearoyl chloride. Useful monocarboxylic acylating agents are available commercially from numerous suppliers and include tall oil fatty acids, oleic acid, stearic acid and isostearic acid. Fatty acids containing 12 to 24 carbon atoms, including C18 acids, are particularly useful.

The polyamine portion may be the same as the polyamines that have been described above. A polyamine is an amine having two or more amine groups where a first amine group is a primary amine group and a second amine group is a primary or secondary amine group. The reaction product of the monocarboxylic acylating agent and the polyamine can contain, in greater or lesser amounts depending on reaction conditions, a heterocyclic reaction product such as 2-imidazoline reaction products as well as amide condensation products. The polyamine can have 2 to 30 carbon atoms. The polyamine can include alkylenediamines, N-alkyl alkylenediamines, and polyalkylenepoly-amines. Useful polyamines include ethylenediamine, 1,2-diaminopropane, N-methylethylenediamine, N-tallow(C16-C18)-1,3-propylenediamine, N-oleyl-1,3-propylenediamine, polyethylenepolyamines such as diethylenetriamine and triethylenetetramine and tetraethylenepentamine and polyethylenepolyamine bottoms.

In another embodiment of the invention the monocarboxylic acylating agent and the polyamine are respectively a C4 to C22 fatty carboxylic acid and an alkylenediamine or a polyalkylenepolyamine, and in a further embodiment the fatty carboxylic acid is isostearic acid and the polyamine is a polyethylenepolyamine such as tetraethylenepentamine.

The monocarboxylic acylating agents and polyamines are commercially available. Their condensation products can generally be prepared by forming a mixture thereof at ambient to elevated temperatures of 50 to 200° C., and heating the mixture at elevated temperatures of 100 to 300° C. until the reaction product is formed in a satisfactory amount, as is more completely described in the reaction procedures in columns 37 and 39 of U.S. Pat. No. 4,724,091.

The amount of the condensation product of the monocarboxylic acylating agent and the polyamine, if it is present, may be 0.5 to 8 percent by weight of the lubricating composition, in another embodiment 1 to 6 percent by weight, or 1.2 to 4 percent by weight or 1.4 to 2 percent or 1.6 to 1.9 percent by weight.

The total amount of all the dispersants may be, in some embodiments, 3 to 50 percent by weight, or 5 to 40, or 10 to 20, or 12 to 18 percent by weight.

The total nitrogen content of the lubricant will be provided by the nitrogen in the dispersants plus the nitrogen in other components that may be present, such as amine antioxidants. The total nitrogen content of the lubricant compositions will be at least 0.2 or 0.3 percent by weight, such as at least 0.4 or 0.5%. A suitable upper limit may be 2 or 1 or 0.8 percent by weight.

Other Components

Other conventional components may also be present, including pour point depressants; friction modifiers such as fatty esters; viscosity index modifiers; metal deactivators; rust inhibitors, high pressure additives, anti-wear additives, and antifoam agents. Any of these materials can be present or can be eliminated, if desired.

Antioxidants (or oxidation inhibitors), including hindered phenolic antioxidants such as 2,6,-di-t-butylphenol and 2,6 di-t-butylphenol with various substituents at the 4 position, including those derived from acrylate ester, secondary aromatic amine antioxidants such as dialkyl (e.g., dinonyl) diphenylamine, sulfurized phenolic antioxidants, oil-soluble copper compounds, phosphorus-containing antioxidants, molybdenum compounds such as the Mo dithiocarbamates, organic sulfides, disulfides, and polysulfides. An extensive list of antioxidants is found in U.S. Pat. No. 6,251,840.

The role of the corrosion inhibitor is to preferentially adsorb onto metal surfaces to provide protective film, or to neutralize corrosive acids. Examples of these include, but are not limited to ethoxylates, alkenyl succinic half ester acids, zinc dithiophosphates, metal phenolates, basic metal sulfonates, fatty acids and amines.

Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162.

Pour point depressants are used to improve the low temperature properties of oil-based compositions. See, for example, page 8 of "Lubricant Additives" by C. V. Smalheer and R. Kennedy Smith (Lezius Hiles Co. publishers, Cleveland, Ohio, 1967). Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants are described in U.S. Pat. Nos. 2,387,501; 2,015,748; 2,655,479; 1,815,022; 2,191,498; 2,666,746; 2,721,877; 2,721,878; and 3,250,715.

Additional components that are typically included in a fuel designated JP-5 may include anti-icing compounds such as diethylene glycol monomethyl ether; metal deactivators including alkarylamines such as N,N'-disalicylidene-1,2-propanediamine; and static dissipators, typically sulfones such as the commercially available material Stadis 450™.

The lubricant compositions of the present invention can be prepared by mixing the indicated components directly, or by preparing one or more of the components in the form of a concentrate, to which other components (such as oil or solvent) can subsequently be added. The corresponding fuel compositions may be prepared by mixing the lubricant composition with an appropriate amounts of liquid fuel, as described above.

The lubricant as described herein, and the lubricant-fuel mixtures as described herein, may be used to lubricate and fuel a two-stroke cycle internal combustion engine. Such engines, when designed or modified to burn liquid fuels having a volatility less than that of gasoline, as described above, are typically spark-ignited engines, direct fuel injected, stratified fuel charged engines. They typically are relatively large engines, of power output of at least 150 kW (201 horsepower), in contrast to smaller engines used for lawnmowers, garden tools, or personal vehicles.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which set forth particularly advantageous embodiments. While the Examples are provided to illustrate the present invention, they are not intended to limit it.

Example 1

A lubricant composition is prepared containing the following components:

22.9% synthetic ester oil basestock based on pentaerythritol, 12 $mm^2/s$ at 100° C.

18.5% Stoddard solvent 12.2% mineral oil, 325 Neutral 25.7% polyisobutylene, molecular weight about 1000

1.8% bright stock 8.3% succinimide dispersant, 86.5% active chemical, 13.5% diluent oil, TBN 100, nitrogen content 4.1% (4.73% excluding diluent oil), having alkyl substituent groups of about 1000 $M_n$.

7.7% Mannich dispersant, 88% active chemical, 12% diluent oil, nitrogen content 1.13% (1.28% excluding diluent oil)

1.8% of the condensation product of isostearic acid and tetraethylenepentamine (neat; nitrogen content 6.35%)

1.0% minor components (e.g., antioxidant, corrosion inhibitor, emulsifier, friction modifier)

Example 2

A lubricant formulation is prepared with the same composition as that of Example 1, except that the amount of 325 Neutral oil is decreased to 4.2% and the Stoddard solvent is replaced with 26.5% kerosene.

Example 3 (Comparative)

Example 1 is duplicated but omitting the succinimide dispersant and proportionally increasing the amounts of the other components.

Example 4 (Comparative)

A premium grade original equipment manufacturer's oil designed for direct fuel injected outboard engines consuming gasoline is provided. It is believed to contain 46.9% mineral oil (325 to 650 Neutral), 15% bright stock, 22% conventional solvents, and 16.1% commercial two-cycle gasoline additives.

Certain of the above compositions are tested in lubrication of a 168 kW (225 hp) outboard engine (Optimax™ from Mercury Marine) operated with a stratified fuel charge. The engine is fueled with an aviation fuel known as "AvJet A," which is a JP5-type fuel, 700 ppm sulfur, flash point 47° C. (Jet A fuel is described in the above Kirk-Othmer reference, pages 331-332, with reference to ASTM D1655.) The fuel contains the lubricant of Example 1, 2, or 3, using a fuel/lubricant ratio of 32.1. The propeller shaft is attached to a dynamometer to simulate real-world torque and load. The engine is operated under conditions of an endurance test cycle, consisting of repeated cycles of 4 minutes at 55% throttle (3750 r.p.m., revolutions per minute) followed by 6 minutes of full throttle (5600 r.p.m.). The test continue for 400 hours or until termination of the test upon engine failure or observation of excessive engine deposit formation. Test results are reported in the following Table:

| Ex. | Hours to termination | Observation |
|---|---|---|
| 1 | 400 | Piston cleanliness equal to or better than that of gasoline fueled engine; very little or no wear |
| 3 (comp) | 55 | Sticky deposits observed in piston grooves; test terminated due to expected premature failure |
| 4 (comp) | 50 | Failure of engine due to seizure: piston rings stuck, followed by detonation and piston failure |

The result show that conventional 2-cycle lubricants do not perform satisfactorily with JP5 fuel, whereas the lubricant of the present invention performs well.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, byproducts, derivatives, and other such materials which are normally understood to be present in the commercial grade. However, the amount of each chemical component is presented exclusive of any solvent or diluent oil, which may be customarily present in the commercial material, unless otherwise indicated. It is to be understood mount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A method for lubricating a two-stroke cycle internal combustion engine comprising the steps of:

supplying to a two-stroke internal combustion engine designed to operate on only gasoline, a liquid fuel selected from the group consisting of jet fuel, diesel fuel, kerosene, and a middle distillate and a lubricating amount of the lubricant composition, the lubricating composition comprising;

(a) at least about 5 percent by weight of an oleaginous synthetic ester;

(b) at least about 5 percent by weight of a normally liquid solvent other than an oil of lubricating viscosity or the oleaginous synthetic ester having a kinematic viscosity of less than about 2 $mm^2/s$ at 100° C.; and (c) about 3 to about 30 percent by weight of a nitrogen-containing dispersant bearing a hydrocarbyl group of at least 26 carbon atoms and having a nitrogen content of at least 3 percent by weight;

wherein the nitrogen content of the lubricant is at least about 0.2 percent by weight; and wherein the engine has a power output of at least about 150 kW (201 horsepower);

resulting in said engine being able to operate on said fuel without premature engine failure due to said fuel.

2. The method of claim 1, wherein said fuel is jet fuel.

3. The method of claim 1, wherein the engine is a spark-ignited engine.

4. The method of claim 1, wherein the engine is a stratified charge engine.

5. The method of claim 1, wherein the liquid fuel is a middle distillate fuel.

6. The method of claim 1, wherein the fuel and lubricant composition are premixed externally to the engine.

7. The method of claim 6, wherein the amount of the lubricant mixed in the fuel is about 1 percent to about 6 percent by weight.

8. The method of claim 1, wherein the engine is equipped with a direct injection fuel system.

9. The method of claim 1, wherein the lubricant is not premixed with the fuel externally to the engine.

* * * * *